US007297855B2

(12) United States Patent
Nishida

(10) Patent No.: US 7,297,855 B2
(45) Date of Patent: Nov. 20, 2007

(54) KEYBOARD APPARATUS AND METHOD OF PRODUCING THE KEYBOARD APPARATUS

(75) Inventor: Kenichi Nishida, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 11/489,294

(22) Filed: Jul. 18, 2006

(65) Prior Publication Data

US 2007/0017340 A1 Jan. 25, 2007

(30) Foreign Application Priority Data

Jul. 21, 2005 (JP) ..... 2005-211507
Jun. 5, 2006 (JP) ..... 2006-156172

(51) Int. Cl.
*G10C 3/12* (2006.01)

(52) U.S. Cl. ..... 84/423 R

(58) Field of Classification Search ..... 84/423 R, 84/477, 478, 430, 441, 423 A
See application file for complete search history.

(56) References Cited

U.S. PATENT DOCUMENTS

| | | | | |
|---|---|---|---|---|
| 4,205,583 | A | 6/1980 | Absmann | |
| 4,308,783 | A | 1/1982 | Absmann | |
| 4,901,614 | A * | 2/1990 | Kumano et al. | 84/719 |
| 6,156,963 | A | 12/2000 | Masubuchi et al. | |

FOREIGN PATENT DOCUMENTS

| | | |
|---|---|---|
| JP | 60-052439 | 3/1985 |
| JP | 10-240228 | 9/1998 |
| JP | 3060938 | 4/2000 |

* cited by examiner

*Primary Examiner*—Kimberly Lockett
(74) *Attorney, Agent, or Firm*—Morrison & Foerster LLP

(57) ABSTRACT

A keyboard apparatus having mass bodies that pivotally move in accordance with a key operation that facilitates key attachment operations. In a key unit, a plurality of keys having driving parts are integrally connected by a common base end part in a condition in which the keys are pivotally movable. A plurality of mass bodies have driven parts disposed in correspondence to the driving parts of the keys, respectively, and are disposed in a pivotally movable condition with respect to a key frame having a securing part. In an assembled state in which the common base end part is secured to the securing part and the driving parts are engaged with the corresponding driven parts, respectively, in response to a pivotal movement of each of the keys, the corresponding driven parts are driven by the driving parts, respectively, so that the corresponding mass bodies pivotally move. By moving the key unit in a longitudinal direction of the keys in a state in which the mass bodies are disposed in the key frame, the driving parts of all of the keys of the key unit simultaneously engage with the corresponding driven parts, respectively, and when the driving parts are simultaneously engaged with the driven parts, the common base end part is positioned at a position in which the common base end part can be secured to the securing part.

18 Claims, 8 Drawing Sheets

KEYBOARD APPARATUS AND METHOD OF PRODUCING THE KEYBOARD APPARATUS

BACKGROUND OF THE INVENTION

1. Field of the Invention

This invention relates to a keyboard apparatus having mass bodies that pivotally move in accordance with a key operation and a method for producing the keyboard apparatus.

2. Description of the Related Art

Conventionally, as disclosed in Japanese Patent Publication No. 3060938, a keyboard apparatus is known in which mass bodies corresponding to each key are provided to apply an appropriate inertial force when the key is depressed. This keyboard apparatus is arranged such that mass bodies are pivotally disposed in a key frame or the like, so that the mass bodies pivotally move in accordance with a pivotal movement of the corresponding keys. Each key is provided with a driving part, and a driven part that corresponds to the driving part is provided in the mass body. In response to depression of the key, the driving part drives the driven part such that the mass body turns in association with the key.

However, in the above described conventional keyboard apparatus, in order to attach each key to the key frame, the rear end part of the key must be pivotally engaged with a key pivot part, and the driving part of the key must be engaged with the driven part of the corresponding mass body by fitting or the like. It is also necessary to engage the front end part of the key with a key movement guide.

Accordingly, in the process of attaching a key, know-how is required to carry out appropriate alignment and the like in order to engage all the places that should be engaged appropriately, and this work requires skill and experience. For example, it is necessary to carry out an operation to engage the rear end part of a key with a key pivot part while, at substantially the same time, engaging a driving part of the key with a driven part of a mass body. This operation must be carried out for each key, and thus it takes a long time to attach all the keys. Consequently, a problem with a keyboard apparatus provided with mass bodies that pivotally move in accordance with a key operation has been that operations for attaching the keys, in particular, are not easily carried out.

SUMMARY OF THE INVENTION

It is an object of the present invention to provide a keyboard apparatus having mass bodies that pivotally move in accordance with a key operation that facilitates key attachment operations.

To attain the above object, in a first aspect of the present invention, there is provided a keyboard apparatus comprising a key unit in which a plurality of keys having driving parts are integrally connected by a common base end part in a condition in which the keys are pivotally movable, a support member having a key base end part securing part, and a plurality of mass bodies having driven parts disposed in correspondence to the driving parts of the keys, respectively, and which are disposed in a pivotally movable condition with respect to the support member, wherein an assembled state is achieved when the common base end part of the key unit is secured to the key base end part securing part of the support member and the driving parts of the keys of the key unit are engaged with the corresponding driven parts of the mass bodies, respectively, the keyboard apparatus being configured such that, in the assembled state, in response to a pivotal movement of each of the keys, the corresponding driven parts of the mass bodies are driven by the driving parts of the keys, respectively, so that the corresponding mass bodies pivotally move, and by moving the key unit in a longitudinal direction of the keys in a state in which the plurality of mass bodies are disposed in the support member, the driving parts of all of the keys of the key unit simultaneously engage with the corresponding driven parts of the mass bodies, respectively, and when the driving parts are simultaneously engaged with the driven parts, the common base end part of the key unit is positioned at a position in which the common base end part can be secured to the key base end part securing part of the support member.

With this arrangement, it is possible to facilitate key attachment operations in a keyboard apparatus having mass bodies that pivotally move in accordance with a key operation.

Preferably, any of the plurality of keys of the key unit is white key, a key guided part is provided at a front end part of each of the white keys, key guide parts is provided in the support member in correspondence to the key guided parts of the white keys, the key guide parts engage with the key guided parts of the white keys in the assembled state to guide pivotal movements of the corresponding white keys, the longitudinal direction of the keys is a rearward direction of the keyboard apparatus, and substantially simultaneously to the driving parts of the keys of the key unit engaging simultaneously with the corresponding driven parts of the mass bodies, the key guided parts of the white keys engage with the corresponding key guide parts.

With this arrangement, through an action to engage each key of a key unit with a mass body, it is possible to engage a key guided part of a key with a key guide part to thereby facilitate key attachment operations even in a keyboard apparatus having a key movement guide.

Preferably, the keyboard apparatus comprises a key mounting guide part that guides the driving parts of the keys of the key unit to the corresponding driven parts of the mass body in a process for attaching the key unit.

Also preferably, the keyboard apparatus comprising a guiding member that is configured as a separate member to the support member, the support member is provided with a mounting part for mounting the guiding member, in the guiding member, a key mounting guide part that guides the driving parts of the keys of the key unit to the corresponding driven parts of the mass bodies when the key unit is attached in a state in which the guiding member is mounted on the mounting part of the support member, and the guiding member can be detached from the mounting part in a state in which the key unit is still attached thereto after attachment of the key unit.

More preferably, the key mounting guide part defines a position in a vertical direction of the driving part of each key in a process for attaching the key unit by contacting against the driving part, and a sectional form in a side view direction of a plurality of contact locations that contact against the driving part of each key in the key mounting guide part is the same for the plurality of contact locations.

More preferably, the key mounting guide part defines a position in a vertical direction of the driving part of each key in a process for attaching the key unit by contacting against the driving part, a position in a vertical direction of the key mounting guide part in attaching the key unit is adjacent to an upper end position of the driven parts of the mass bodies disposed in the support member.

More preferably, the key mounting guide part defines a position in a vertical direction of the driving part of each key in a process for attaching the key unit by contacting against the driving part, and a clearance between the key mounting guide part and each of the driven parts of the mass bodies disposed in the support member is less than a width in a front-to-rear direction of the corresponding driving part of the key of the key unit.

Also more preferably, the key mounting guide part defines a position in a vertical direction of the driving part of each key in a process for attaching the key unit by contacting against the driving part, and the key mounting guide part slopes downward towards a side of each of the driven part of the mass bodies.

More preferably, the keyboard apparatus comprises a mass body mounting guide part for disposing the plurality of mass bodies in a pivotally movable condition in the support member.

Still more preferably, the mass body mounting guide part also serves as the key mounting guide part.

To attain the above object, in a second aspect of the present invention, there is provided a method of producing a keyboard apparatus comprising a key unit in which a plurality of keys having driving parts are integrally connected by a common base end part in a condition in which the keys are pivotally movable, a support member having a key base end part securing part, and a plurality of mass bodies having driven parts disposed in correspondence to the driving parts of the keys, respectively, and which are disposed in a pivotally movable condition with respect to the support member, wherein an assembled state is achieved when the common base end part of the key unit is secured to the key base end part securing part of the support member and the driving parts of the keys of the key unit are engaged with the corresponding driven parts of the mass bodies, respectively, and the keyboard apparatus being configured such that, in the assembled state, in response to a pivotal movement of each of the keys, the corresponding driven parts of the mass bodies are driven by the driving parts of the keys, respectively, so that the corresponding mass bodies pivotally move, the method being a method for attaching the plurality of mass bodies and the key unit to the support member, comprising the steps of disposing the plurality of mass bodies in the support member in a condition in which each mass body is pivotally movable, engaging the driving parts of all of the keys of the key unit with the corresponding driven parts of mass bodies, respectively, by moving the key unit in a longitudinal direction of the keys, simultaneously, and positioning the common base end part of the key unit at a position in which the common base end part can be secured to the key base end part securing part of the support member, and securing the common base end part of the key unit to the key base end part securing part of the support member.

With this arrangement, it is possible to facilitate key attachment operations in a keyboard apparatus having mass bodies that pivotally move in accordance with a key operation.

To attain the above object, in a third aspect of the present invention, there is provided a method of producing a keyboard apparatus comprising a key unit in which a plurality of white keys having driving parts and provided with key guided parts at respective front end parts and a plurality of black keys having driving parts are integrally connected in a pivotally movable condition, respectively, by a common base end part, a support member provided with a key base end part securing part and key guide parts that correspond to the key guided parts of the white keys of the key unit and engages with the corresponding key guided parts to guide pivotal movements of the corresponding white keys, respectively, and a plurality of mass bodies that have driven parts disposed in correspondence to the driving parts of the keys and that are disposed in a pivotally movable condition with respect to the support member, wherein an assembled state is achieved when the common base end part of the key unit is secured to the key base end part securing part of the support member, and the driving parts of the keys of the key unit are engaged with the corresponding driven parts of the mass bodies, respectively, the keyboard apparatus being configured such that, in the assembled state, in response to a pivotal movement of each of the keys, the corresponding driven parts of the mass bodies are driven by the driving parts of the keys, respectively, so that the corresponding mass bodies pivotally move, the method being a method for attaching the plurality of mass bodies and the key unit to the support member, comprising the steps of disposing the plurality of mass bodies in the support member in a condition in which each mass body is pivotally movable, engaging the driving parts of all of the keys of the key unit with the corresponding driven parts of mass bodies, simultaneously, by moving the key unit rearward, and at substantially the same time, engaging the key guided parts of the white keys with the corresponding key guide parts, respectively, and positioning the common base end part of the key unit at a position in which the common base end part can be secured to the key base end part securing part of the support member, and securing the common base end part of the key unit to the key base end part securing part of the support member.

To attain the above object, in a fourth aspect of the present invention, there is provided a keyboard apparatus comprising a key unit in which a plurality of keys including black keys and white keys having driving parts are integrally connected by a common base end part in a condition in which each key is pivotally movable, key guided parts each of which is provided at a front end part of each of the white keys among the plurality of keys of the key unit, a support member having a key base end part securing part, key guide parts that are provided in the support member and correspond to the key guided parts of the white keys, respectively, and that engage with the key guided parts in an assembled state to guide pivotal movements of the corresponding white keys, and a plurality of mass bodies that have driven parts that are disposed in correspondence to the driving parts of the keys, respectively, and that are provided in a pivotally movable condition with respect to the support member, wherein an assembled state is achieved when the common base end part of the key unit is secured to the key base end part securing part of the support member, and the driving parts of the keys of the key unit are engaged with the corresponding driven parts of the mass bodies, respectively, the keyboard apparatus being configured such that, in the assembled state, in response to a pivotal movement of each of the keys, the corresponding driven parts of the mass bodies are driven by the driving parts of the keys, respectively, so that the corresponding mass bodies pivotally move, and by moving the key unit in a longitudinal direction of the keys in a state in which the plurality of mass bodies are disposed in the support member, the key guided parts of all the white keys of the key unit simultaneously engage with the corresponding key guide parts, respectively, and when the key guided parts of all the white keys are simultaneously engaged with the corresponding key guide parts, the common base end part of the key unit is positioned at a position in which the common base end part can be secured to the key base end part securing part of the support member.

With the arrangements according to the third and fourth aspects of the present invention, it is possible to facilitate key attachment operations in a keyboard apparatus that has mass bodies that pivotally move in accordance with a key operation and also has a key movement guide.

Preferably, any one of the key guide part and the key guided part is provided with an engaging guide part that guides the key guide part and the key guided part into an engaged state.

Also, preferably, the longitudinal direction of the keys is a rearward direction of the keys.

With this arrangement, it is possible to facilitate engagement of a key guide part with a key guided part of a key, to thereby further facilitate key attachment operations.

To attain the above object, in a fifth aspect of the present invention, there is provided a keyboard apparatus comprising a key unit in which a plurality of keys including black keys and white keys having driving parts are integrally connected by a common base end part in a condition in which each key is pivotally movable, key guided parts each of which is provided at a front end part of each of the white keys among the plurality of keys of the key unit, a support member having a key base end part securing part, key guide parts that are provided in the support member and correspond to the key guided parts of the white keys, respectively, and that engage with the key guided parts in an assembled state to guide pivotal movements of the corresponding white keys, and a plurality of mass bodies that have driven parts that are disposed in correspondence to the driving parts of the keys, respectively, and that are provided in a pivotally movable condition with respect to the support member, wherein an assembled state is achieved when the common base end part of the key unit is secured to the key base end part securing part of the support member, and the driving parts of the keys of the key unit are engaged with the corresponding driven parts of the mass bodies, respectively, the keyboard apparatus being configured such that, in the assembled state, in response to a pivotal movement of each of the keys, the corresponding driven parts of the mass bodies are driven by the driving parts of the keys, respectively, so that the corresponding mass bodies pivotally move, and by moving the key unit in a longitudinal direction of the keys in a state in which the plurality of mass bodies are disposed in the support member, the driving parts of all the keys of the key unit simultaneously engage with the corresponding driven parts of the mass bodies, respectively, and in parallel with which, the key guided parts of all the white keys of the key unit simultaneously engage with the corresponding key guide parts, and when the driving parts are simultaneously engaged with the driven parts, the common base end part of the key unit is positioned at a position in which the common base end part can be secured to the key base end part securing part of the support member.

With the arrangement according to the fifth aspect of the present invention, it is possible to facilitate key attachment operations in a keyboard apparatus that has mass bodies that pivotally move in accordance with a key operation and also has a key movement guide.

Preferably, claim any one of the key guide part and the key guided part is provided with an engaging guide part that guides the key guide part and the key guided part into an engaged state.

With this arrangement, it is possible to facilitate engagement of a key guide part with a key guided part of a key, to thereby further facilitate key attachment operations.

Preferably, the longitudinal direction of the keys is rearward.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

First, a first embodiment of the present invention will be described.

Figure 1:
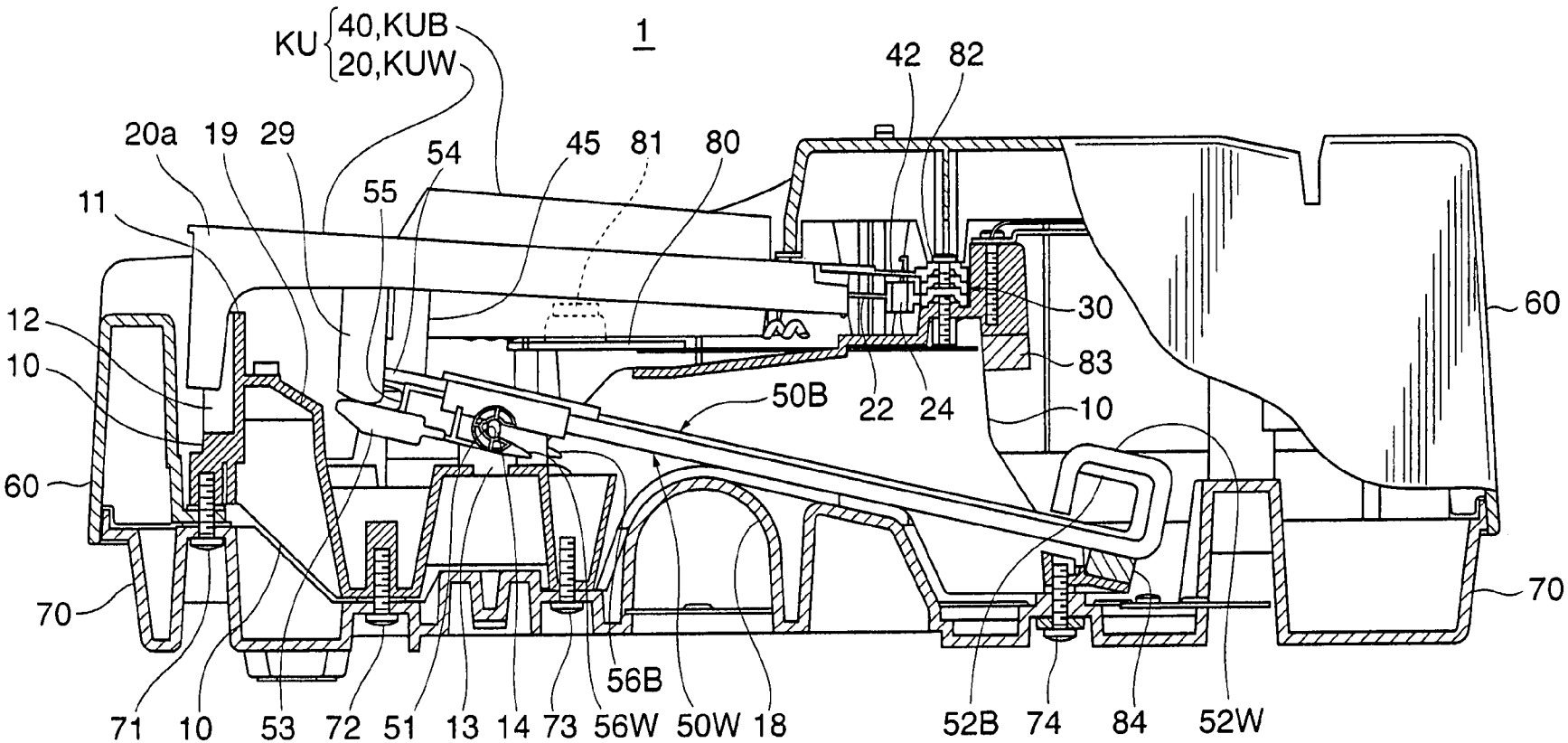
FIG. 1 is a longitudinal sectional view of a keyboard apparatus according to a first embodiment of the present invention.

FIG. 1 is a longitudinal sectional view of a keyboard apparatus according to the first embodiment of the present invention. This keyboard apparatus 1 is configured as an electronic keyboard musical instrument. Hereafter, the player side (the left side in FIG. 1) of the keyboard apparatus 1 is referred to as "the front."

As shown in FIG. 1, in the keyboard apparatus 1, a key frame 10 is disposed inside a casing that is comprised of an upper case 60 and a lower case 70. A plurality of key units KU which are comprised of a plurality of white keys 20 and a plurality of black keys 40 are disposed in the key frame 10. A common base end part 30 of each key unit KU is fixedly held by the key frame 10, and respective free ends of the white keys 20 and the black keys 40 are provided such that they pivotally move (or swing) in a vertical direction. The configuration of the key unit KU is described in detail later.

The key frame 10 is joined to the lower case 70 by a plurality of screws 72, 73 and 74. The lower case 70, the upper case 60 and the key frame 10 are joined at the respective front parts thereof by securing these parts together with a plurality of screws 71. Further, the lower case 70 and the upper case 60 are joined by a plurality of screws at appropriate positions in their respective rear parts (not shown in the figure). At a lower part of the lower case 70 is formed a concave part 18 for housing a battery or the like.

Hereafter, the same symbols may be used for elements corresponding to the white keys 20 and the black keys 40 and elements of the same kind among the constituent elements of the keyboard apparatus 1. However, when it is necessary to distinguish between elements corresponding to the white keys 20 and elements corresponding to the black keys 40, a distinction is made by adding the reference character "W" or "B", respectively, after the relevant symbol.

Mass bodies 50 (50W, 50B) are provided in the key frame 10 in a manner corresponding to the white keys 20 and black keys 40 respectively. Each of the mass bodies 50W, 50B are supported by respective bearings 51 such that the mass bodies 50W, 50B can pivotally move in a vertical direction about a pivot 14 (14W, 14B; described later in FIG. 6) that is provided in mass body support ribs 13 (13W, 13B; described later with reference to FIG. 6) formed in the key frame 10. The mass of each of the mass bodies 50W, 50B is mainly concentrated on rear end parts 52 (52W, 52B) of the mass bodies 50W, 50B. Each mass body 50 pivotally moves in accordance with movement of the corresponding key (described in detail later), and whereby the mass body 50 applies an appropriate inertial force to the corresponding key to realize a touch feeling that is similar to that of an acoustic piano.

An upper limit stopper 83 is provided on the upper side of the rear part of the key frame 10, and a lower limit stopper 84 is provided on the lower side of the rear part of the key frame 10. Although the upper limit stopper 83 and the lower limit stopper 84 may be provided in a one-to-one correspondence with the keys, in the present embodiment the upper limit stopper 83 and the lower limit stopper 84 are commonly provided for a plurality of keys (for example, for all keys or for all keys in a single key unit KU). A non-depressed position (initial position) of the mass body 50 and the key corresponding thereto is defined by the rear end part 52 of the mass body 50 being held in contact against the lower limit stopper 84. In contrast, a key depression end position (pivotal movement end position) of the mass body 50 and the key corresponding thereto is defined by contact of the rear end part 52 of the mass body 50 against the upper limit stopper 83.

Key-on switches 81 are provided in a one-to-one correspondence with the white keys 20 and the black keys 40 on a base plate 80 provided in the key frame 10. These key-on switches 81 detect depression operations for the corresponding keys. Musical sound is generated by an unshown musical sound generating part based on the results of detection by the key-on switches 81.

Key guide parts 12 that guide a key depression operation are provided in a one-to-one correspondence with the white keys 20 at the front part of the key frame 10. A key guided part 33 (described later with reference to FIG. 4) that engages with the key guide part 12 is formed at a front end part 20*a* of the white key 20, and by engagement of the key guide part 12 and the key guided part 33 with each other, horizontal movement of the front end part 20*a* of the white key 20 is limited such that the front end part 20*a* moves appropriately in the vertical direction.

Figure 2:
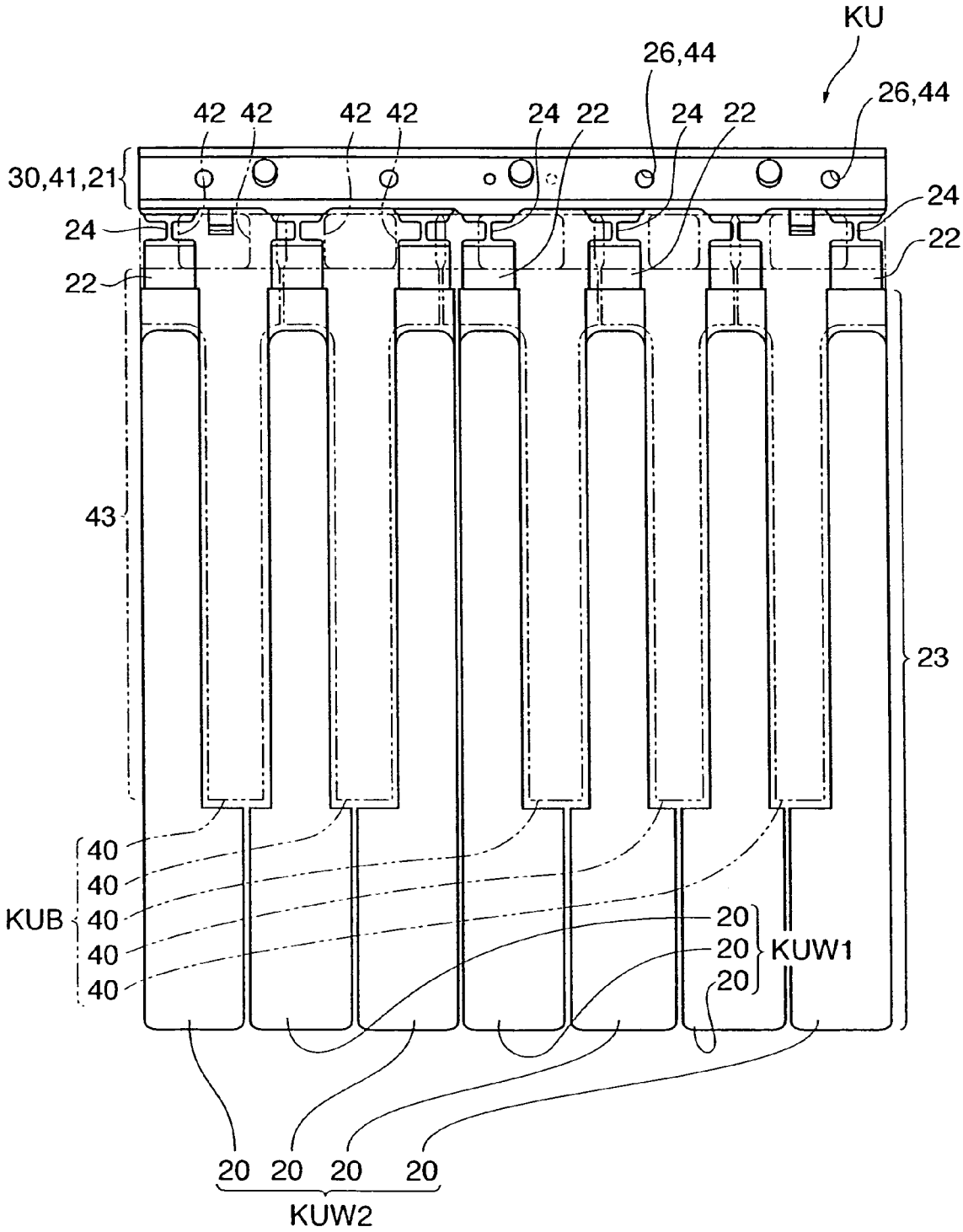
FIG. 2 is a plan view of one key unit in the keyboard apparatus shown in FIG. 1.
Figure 3:
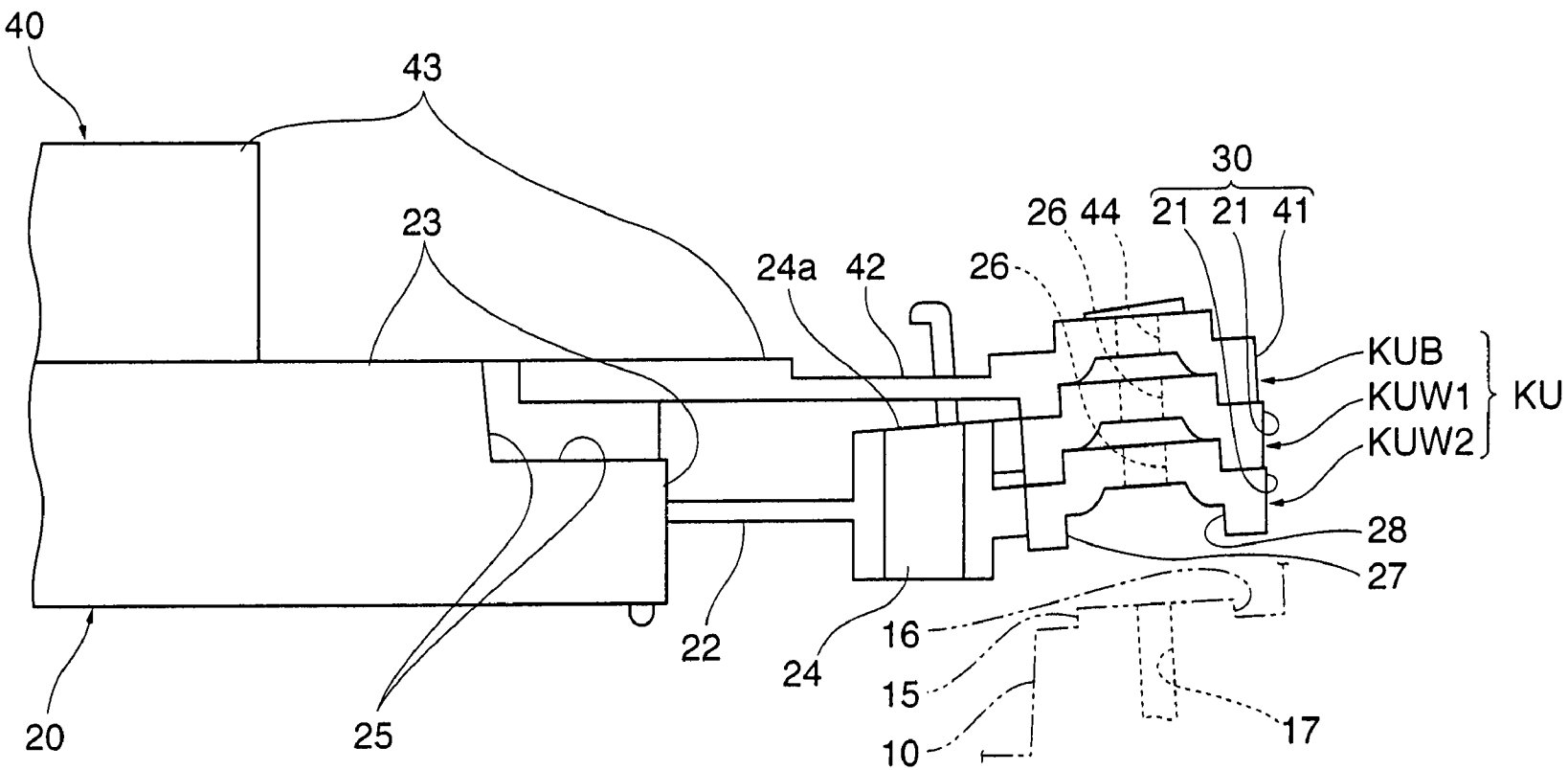
FIG. 3 is a side view of a rear half of the key unit.

FIG. 2 is a plan view of the single key unit KU. The key unit KU is comprised of two white key units KUW (KUW1, KUW2) and one black key unit KUB. In FIG. 2, the key unit KUB is shown by a phantom line. FIG. 3 is a side view of the rear half of the key unit KU.

Although, as shown in FIG. 2, according to the present embodiment each key unit KU is configured by taking one octave as a unit, the present embodiment is not limited thereto and any configuration may be adopted as long as it includes a plurality of keys, and the configuration may be one in which keys of two octaves or more are combined. As shown in FIG. 2 and FIG. 3, the white key unit KUW consists of a first white key unit KUW1 in which white keys 20 for the pitch names "D, F, and A" are integrally connected at a base end part 21 and a second white key unit KUW2 in which white keys 20 for "C, E, G, and B" are integrally connected at the base end part 21. In the black key unit KUB, the black keys 40 for the pitch names "C#, D#, F#, G#, and A#" are integrally connected at a base end part 41. The common base end part 30 is composed of the base end part 21 and the base end part 41.

White key main bodies 23 are coupled to the base end parts 21 of the first white key unit KUW1 and the second white key unit KUW2, respectively, through vertical hinge parts 24 and horizontal hinges 22 that are each in the form of a thin plate. The vertical hinge part 24 that is joined to the base end part 21 can bend easily in the horizontal direction, and in a free state it allows swinging of the free end of the white key main body 23 in a key-alignment direction (horizontal direction). By synergistic action of the vertical hinge part 24 with the key guided part 33 and key guide part 12 that are described later, displacement of the white key main body 23 in the key-alignment direction due to a production error or assembly error or the like can be appropriately corrected.

The horizontal hinge 22 that connects to the front side of the vertical hinge part 24 bends easily in the vertical direction, and in a free state it allows the free end of the white key main body 23 to pivotally move in a key depression/release direction (vertical direction) with respect to the base end part 21 and the vertical hinge part 24. In a strict sense, a part connecting the horizontal hinge 22 and the vertical hinge part 24 constitutes a pivot part of the white key main body 23. At an upper part of the rear part of the white key main body 23, a recess portion 25 is formed to prevent interference with the black key 40 when the black key 40 pivotally moves (see FIG. 3).

In the black key unit KUB, the black key main bodies 43 are coupled to the base end part 41 through laminated horizontal hinges 42. As shown by chain double-dashed lines in FIG. 2, two of the horizontal hinges 42 are provided for each of the black key main bodies 43, and are formed at positions in which they are spaced from each other. Similarly to the horizontal hinge 22, the horizontal hinge 42 allows the free end of the black key main body 43 to pivotally move in the key depression/release direction with respect to the base end part 41. In a strict sense, a part connecting the horizontal hinge 42 and the base end part 41 constitutes a pivot part of the black key main body 43.

The base end part 21 of the second white key unit KUW2, the base end part 21 of the first white key unit KUW1, and the base end part 41 of the black key unit KUB are fitted in a layered manner in that order from the bottom, and these base end parts 21, 21 and 41 constitute the common base end part 30. A plurality of screw fastening holes 26, 26 and 44 are formed in the base end parts 21, 21 and 41, respectively. At the lower part of the base end part 21 of the second white key unit KUW2, which is also the lower part of the common base end part 30, contact surfaces 27 and 28 are formed in mutual opposition. The contact surfaces 27 and 28 serve as positioning references in the front-to-rear direction.

Figure 6:
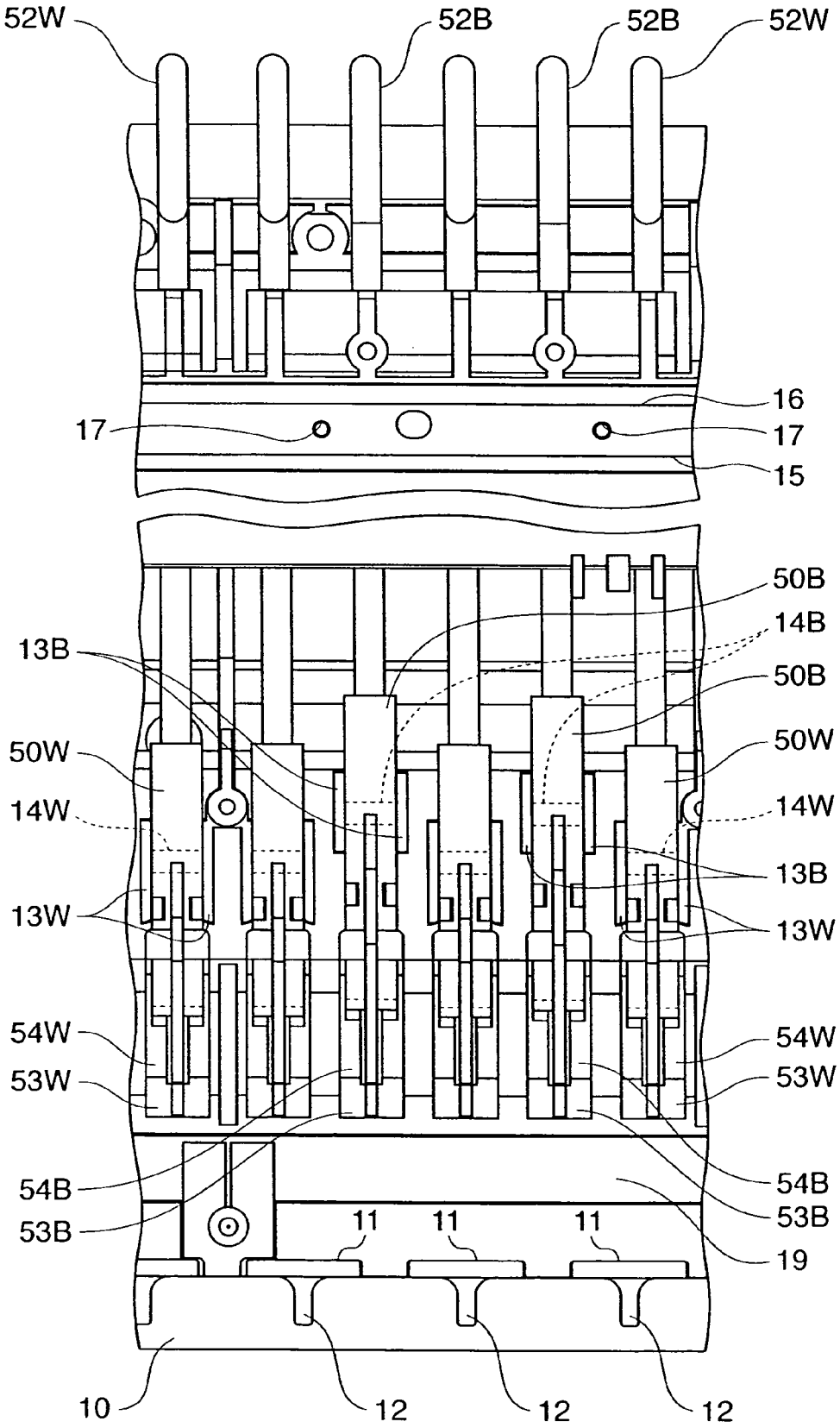
FIG. 6 is a fragmentary plan view showing a state in which mass bodies are arranged in a key frame of the keyboard apparatus.

At an upper part that is slightly rear of the center in the front-to-rear direction in the key frame 10, securing parts 15 and 16 for securing the common base end part 30 are formed in correspondence to the contact surfaces 27 and 28 (refer also to FIG. 6). The securing parts 15 and 16 are formed by a front end surface and a rear end surface, respectively, of a portion protruding upward from the key frame 10. At intermediate positions between the securing parts 15 and 16 in the front-to-rear direction in the key frame 10, a plurality of screw holes 17 are formed in correspondence to the screw fastening holes 26 and 44 (refer also to FIG. 6).

The common base end part 30 can be tightly secured to the key frame 10 by bringing the contact surfaces 27 and 28 of the common base end part 30 into contact with the securing parts 15 and 16 and screwing the screw 82 (see FIG. 1) into the screw hole 17 through the screw fastening holes 26 and 44 of the common base end part 30. The white keys 20 and black keys 40 thereby enter a state in which the white and black keys 20 and 40 pivotally move in response to a performance operation. In this connection, the fixing state of the common base end part 30 is not limited to the above described state.

In the unified key unit KU, the horizontal hinges 42 of the black keys 40 are positioned further rearward that the horizontal hinges 22 of the white keys 20. Thus, the distance from the free end of the black keys 40 to the above described pivot part is made as long as possible to enhance the performance operability of the black keys 40. Further, the positions in the front-to-rear direction of the vertical hinge parts 24 and the horizontal hinges 42 substantially match, and thus the vertical hinge parts 24 of the white keys 20 are positioned almost directly below the horizontal hinges 42 of the black keys 40. More specifically, the vertical hinge parts 24 are disposed in a manner that effectively utilizes the space below the horizontal hinges 42. The upper end surface of the vertical hinge part 24 forms a sloping surface 24*a* that slopes slightly downward towards the front (see FIG. 3). As a result, interference between the vertical hinge parts 24 and the horizontal hinges 42 of the black keys 40 can be avoided when the black keys 40 pivotally move in the downward direction.

Figure 4A:
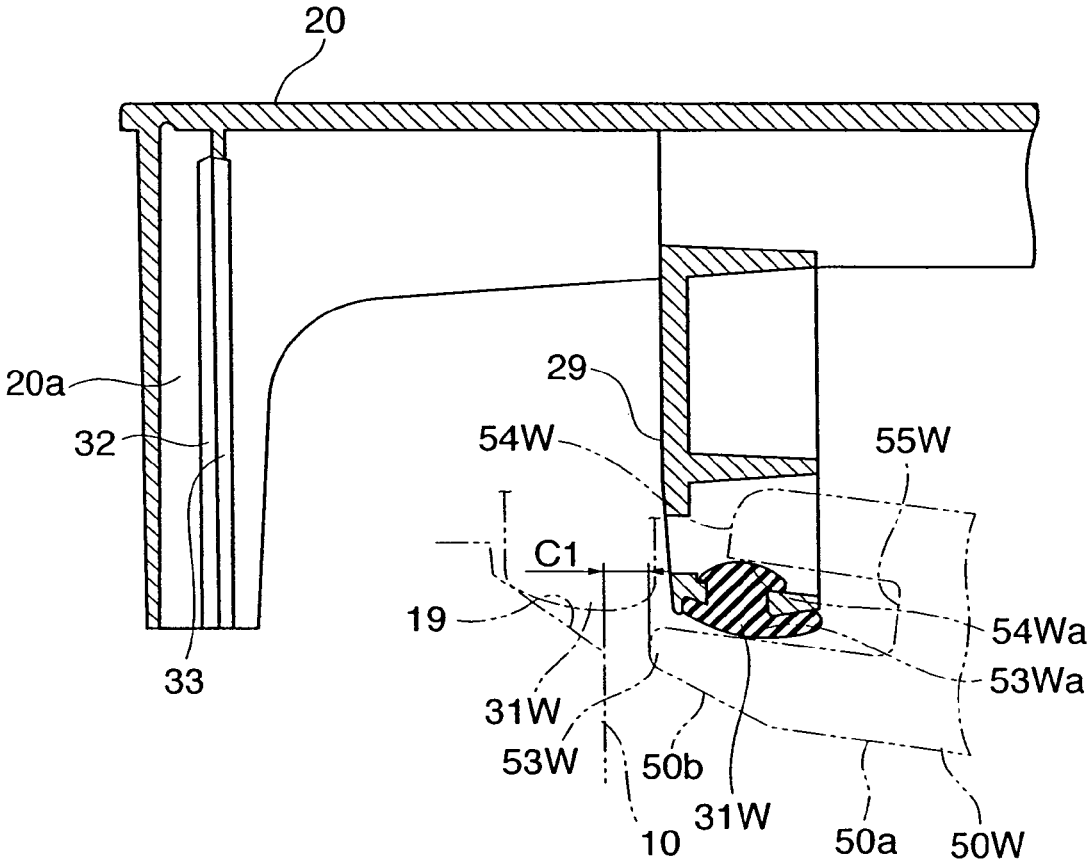
FIG. 4A is a sectional view of a front half of a white key of the key unit.
Figure 4B:
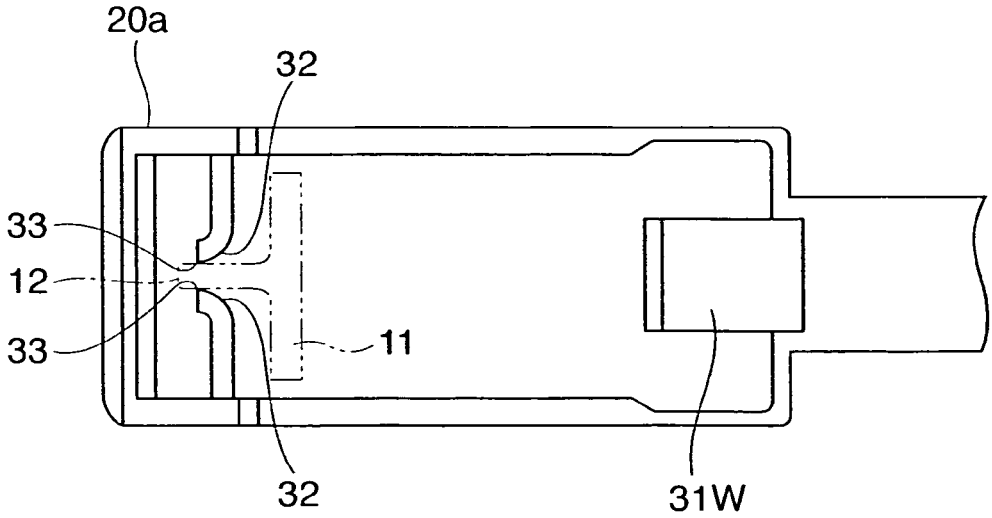
FIG. 4B is a view of a back side surface of the front half of the white key.
Figure 5:
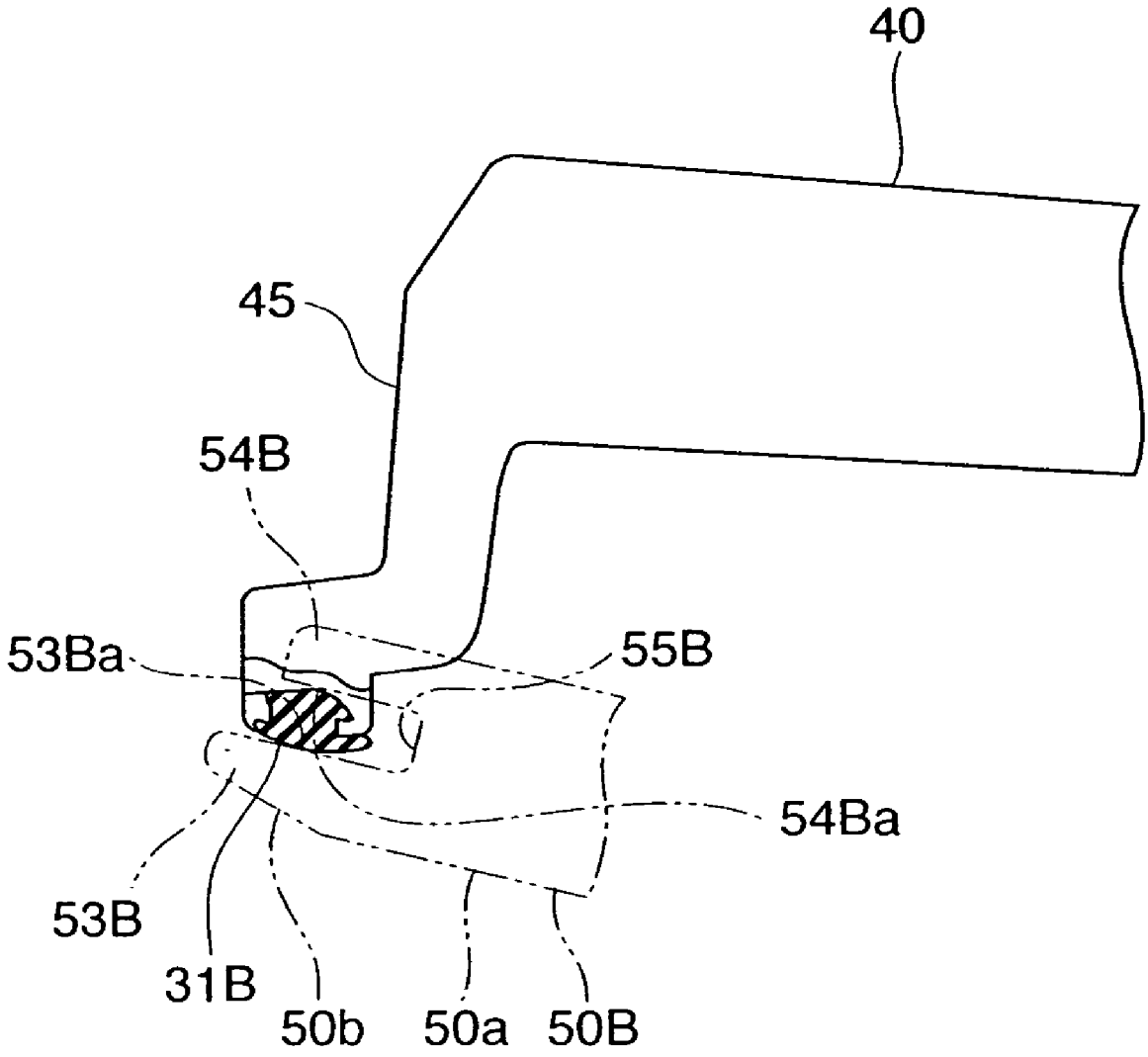
FIG. 5 is a side view (partial sectional view) of a front half of a black key of the key unit.
Figure 7:
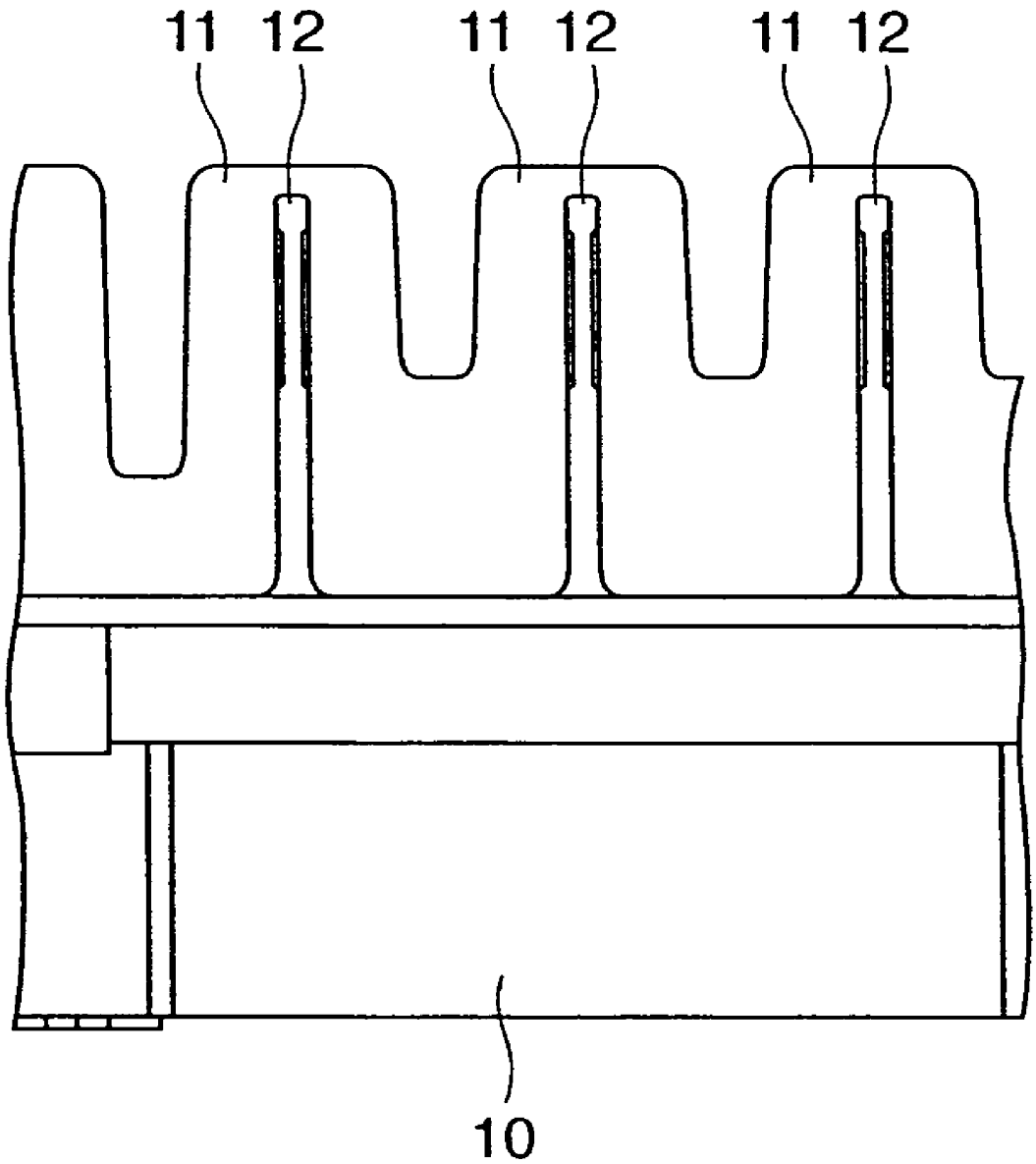
FIG. 7 is a fragmentary front view of the key frame.

FIG. 4A is a sectional view of the front half of the white key 20, and FIG. 4B is a view of a back side surface of the front half of the white key 20. FIG. 5 is a side view (partial sectional view) of a front half of the black key 40. FIG. 6 is a fragmentary plan view showing a state in which the mass bodies 50 are arranged in the key frame 10. FIG. 7 is a fragmentary front view of the key frame 10.

As shown in FIG. 6, the above described mass body support ribs 13 are formed in the key frame 10. The key frame 10 is made of resin, and is injection molded using a metal mold. The mass body support ribs 13 are formed such that they are integrated with the key frame 10 on the top surface of the key frame 10, and the mass body support ribs 13 extend in the shape of a thin plate along the front-to-rear direction and vertical direction. Mass body support ribs 13W and 13B are provided in pairs, respectively, in one-to-one correspondence with the white keys 20 and black keys 40, respectively. All the mass body support ribs 13W and all the mass body support ribs 13B are provided at the same position in the front-to-rear direction. The mass body support ribs 13B are positioned further rearward than the mass body support ribs 13W, and there is only a small overlapping portion between the mass body support ribs 13W and the mass body support ribs 13B in the front-to-rear direction.

The above described pivot 14W and the above described pivot 14B extend across each pair of mass body support ribs 13W and each pair of mass body support ribs 13B, respectively. The pivot 14B is positioned further rearward than the pivot 14W, and these two pivots do not overlap in the front-to-rear direction.

A sloping surface 19 is formed at the front part of the key frame 10. As described later, the sloping surface 19 fulfills a mounting guide function when attaching the mass bodies 50 to the key frame 10 and when attaching the key unit KU thereto. Further, as shown in FIG. 1, FIG. 4B, FIG. 6 and FIG. 7, horizontally parallel ribs 11 are formed at positions corresponding to the white keys 20 at the most frontward part of the key frame 10. The above described key guide parts 12 that extend vertically are integrally formed such that the key guide parts 12 connect to the front surface of the ribs 11.

As shown in FIG. 1, the bearing 51 of the mass body 50 opens to the rear. By fitting the bearing 51 into the pivot 14 from the open side thereof, as shown in FIG. 6, the mass bodies 50W and 50B pivotally move around the pivots 14W and pivots 14B, respectively. When the mass body 50 is in a free state in which the mass body 50 can pivotally move on the pivot 14 (state in which the key is not yet disposed), a rear end part 52 contacts against the lower limit stopper 84 due to its own weight (see FIG. 1), such that the front end part is positioned upward and the rear end part 52 is positioned downward.

Tongues 56 (56W, 56B) are provided in a condition extending toward the rear from the underside of the bearing 51 of the mass body 50. The tongues 56 are made from soft resin or the like and are flexible. The tongues 56 fulfill a guide function when fitting the bearing 51 into the pivot 14. In the open part of the bearing 51, the area in the vicinity of the base of the tongue 56 is narrower than in the vicinity of the tip of the tongue 56, and it is thus difficult for the pivot 14 that was fitted into the bearing 51 to fall out.

As shown in FIG. 4A, FIG. 5 and FIG. 6, the front end parts of the mass bodies 50W and 50B are provided with upper engaging pieces 54W and 54B and lower engaging pieces 53W and 53B as driven parts that are driven by the white keys 20 and the black keys 40, respectively. Fitting concave parts 55W and 55B are formed between these upper engaging pieces 54W, 54B and lower engaging pieces 53W, 53B, respectively (see FIG. 4A and FIG. 5).

In this case, the positional relationships in the front-to-rear direction and vertical direction is the same for the upper engaging pieces 54W and the upper engaging pieces 54B, and the same for the lower engaging pieces 53W and the lower engaging pieces 53B. By providing the pivot 14B further rearward than the pivot 14W, the distance between the lower engaging piece 53B and the pivot 14B is longer than the distance between the lower engaging piece 53W and the pivot 14W (see FIG. 6). Thus, considering that the mass bodies 50, for which the mass of the rear end part 52 is the same, pivotally move individually, due to the leverage relationship, when the lower engaging pieces 53W and 53B are driven, the mass body 50B is pivotally moved by a weaker driving force than the mass body 50W.

As shown in FIG. 4A, at a lower part of the front half of the white key 20, a driving hanging piece 29 is integrally provided in a condition in which the driving hanging piece 29 hangs downward. An elastic member 31W such as rubber or the like is secured at the lower end portion of the driving hanging piece 29. The (lower end of the) elastic member 31W functions as a driving part that directly drives the corresponding mass body SOW. More specifically, after the key unit KU has been appropriately attached to the key frame 10, the elastic member 31W engages between the lower engaging piece 53W and the upper engaging piece 54W in the fitting concave part 55W of the mass body 50W such that the elastic member 31W constantly contacts with an upper surface 53Wa of the lower engaging piece 53W and a lower surface 54Wa of the upper engaging piece 54W.

For example, when the white key 20 is depressed, the elastic member 31W of the driving hanging piece 29 of the white key 20 in question drives the upper surface 53Wa of the lower engaging piece 53W of the corresponding mass body 50W, such that the mass body 50W pivotally moves in the key depression direction (direction in which the front end part of the mass body 50W moves downward) in response to the movement of the white key 20. In contrast, when the white key 20 is released from the key depression, due to the self weight of the mass body 50W and the return force caused by the elasticity of the horizontal hinge 22 of the white key 20, the mass body 50W pivotally moves in the key release direction (direction in which the front end part of the mass body 50W moves upward) together with the white key 20. Accordingly, in a performance operation, the white key 20 and the mass body 50W always pivotally move in accordance with each other.

The configuration of the front end part of the mass body 50B and the engaging relationship between the black key 40 and the mass body 50B are the same as those between the white key 20 and the mass body 50W. More specifically, as shown in FIG. 5, at a lower part of the front half of the black key 40, a driving hanging piece 45 is integrally provided in a condition in which the driving hanging piece 45 hangs downward (see also FIG. 1). An elastic member 31B that is secured at the lower end of the driving hanging piece 45 engages between the lower engaging piece 53B and the upper engaging piece 54B in the fitting concave part 55B of the mass body 50B such that the elastic member 31B constantly contacts against an upper surface 53Ba of the lower engaging piece 53B and a lower surface 54Ba of the upper engaging piece 54B. The action and movement between the black key 40 and the mass body 50B during a performance operation are also the same as those between the white key 20 and the mass body 50W.

As shown in FIGS. 4A and 4B, the above described key guided part 33 is formed in the front end part 20*a* of the white key 20. The key guided part 33 is a long slit in a substantially vertical direction, and has a slightly larger width than the key guide part 12. A guide part 32 that connects to the front part of the key guided part 33 is integrally formed on both the left and right sides of the key guided part 33. When attaching the key unit KU to the key frame 10, the guide part 32 fulfills a guiding function such that the key guide part 12 appropriately engages with the key guided part 33. A lubricant is coated on a sliding surface of the key guide part 12 and the key guided part 33.

As shown in FIG. 1 and FIG. 4A, the above described sloping surface 19 provided at the front part of the key frame 10 slopes downward towards the rear. When the mass body 50 is moved rearward from the front to be attached to the key frame 10, the sloping surface 19 contacts against lower surfaces 50*a* and 50*b* of the front end part of the mass body 50 (see FIG. 4A and FIG. 5) to limit their positions in the vertical direction, and acts in cooperation with the tongue 56 of the mass body 50 to guide the mass body 50 so that the bearing 51 of the mass body 50 fits appropriately on the pivot 14. In a state in which the mass body 50 is attached to the key frame 10, when the key unit KU is moved rearward from the front to be attached to the key frame 10, the sloping surface 19 contacts against the elastic member 31 of each key to restrict the position of the elastic member 31 in the vertical direction, and to guide the key unit KU so that the elastic member 31 of each key fits in the fitting concave part 55 of the corresponding mass body 50.

In this case, with respect to the sloping surface 19, the sectional form in a side view direction of each portion that fulfills the mounting guide function by contacting against the lower surfaces 50*a*, 50*b* of each mass body 50 or the elastic member 31 of each key is the same. More specifically, although the sloping surface 19 need not necessarily have a uniform flat surface across the entire width of the keyboard, and a concave part or the like may be present at some locations, all of the sections that fulfill the guide function are flush with respect to each other. Thus, the processing of a metal mold that is used to form the key frame 10 is simple.

Further, as shown in FIG. 4A, the position of the sloping surface 19 in the vertical direction is adjacent to the upper end position of the lower engaging piece 53 of the attached mass body 50. As a result, when attaching the key unit KU, the elastic member 31 moves by smoothly sliding on the sloping surface 19, and easily rides on the upper surface 53Wa of the lower engaging piece 53W to thereby engage easily into the fitting concave part 55 of the mass body 50. Further, a clearance C1 between the rear end of the sloping surface 19 and the front end of the lower engaging piece 53 of the mass body 50 is less than the smaller one of the widths in the front-to-rear direction of the driving hanging pieces 29 and 45 of the white keys 20 and the black keys 40 (for example, the width of the driving hanging piece 45). Thus, when attaching the key unit KU, the driving hanging pieces 29 and 45 are smoothly guided without falling down from the clearance C1. Further, in attaching the key unit KU, the slope of the sloping surface 19 allows the key unit KU to be moved rearward by utilizing the self weight of the key unit KU when the key unit KU is merely pushed lightly or released at an appropriate position. Thus, the attachment is simple.

The method of attaching the mass bodies 50 and the key unit KU to the key frame 10 according to this configuration will now be described in further detail. Here, conventionally the position of a driven part that corresponds to the lower engaging piece 53 of the mass body 50 is clearly different in the front-to-rear direction and vertical direction between a driven part corresponding to a white key and a driven part corresponding to a black key. Therefore, it has been difficult for an ordinary worker to attach a plurality of keys at the same time, and in practice a work method has been employed in which each key is attached individually. However, as described below, according to the present embodiment it is possible to easily attach the key unit KU having the plurality of keys integrated therein.

First, all of the mass bodies 50 are attached one-by-one to the key frame 10. More specifically, with the open side of the bearing 51 of the mass body 50 facing the pivot 14 (see FIG. 1 and FIG. 6), the mass body 50 is moved rearward while sliding the lower surfaces 50*a*, 50*b* of the front end part of the mass body 50 on the sloping surface 19. The bearing 51 is then fitted into the pivot 14 so that the mass body 50 pivotally moves around the pivot 14. When attachment of all the mass bodies 50 has been completed in a similar manner and the mass bodies 50 are in a free state, all the mass bodies 50 are in a pivot movement initial state. More specifically, the front end parts of all the mass bodies 50 are aligned in the same position in the vertical and key-alignment directions, and the fitting concave part 55 is in a state in which the fitting concave part 55 opens toward the front (see FIGS. 4A, 5 and 6).

Meanwhile, a necessary number of the key units KU (for one octave) in which the white key units KUW1 and KUW2 and the black key unit KUB are overlaid and integrated are constructed, separately. Thereafter, the elastic members 31W and 31B of all the white keys 20 and black keys 40 in a key unit KU are brought into contact with the top of the sloping surface 19 while adjusting the position in the key-alignment direction of the key unit KU. Subsequently, the key unit KU is moved rearward by sliding the key unit KU on the sloping surface 19 with using the self weight of the key unit KU, all of the elastic members 31 in the key unit KU then simultaneously enter a state in which all the elastic members 31 contact against (the top surfaces 53Wa and 53Ba of) the lower engaging pieces 53 of the corresponding mass bodies 50. When the key unit KU is moved further rearward, all of the elastic members 31 simultaneously engage in a fitted state between the lower engaging pieces 53 and the upper engaging pieces 54 (fitting concave parts 55) of the corresponding mass bodies 50 (see FIG. 4A). Thus, by merely sliding the key unit KU to move it rearward, the elastic members 31 can be easily engaged in the fitting concave parts 55 of the mass bodies 50.

Concurrent with the elastic members 31 engaging in the fitting concave parts 55, the key guided parts 33 of the white keys 20 in the key unit KU naturally engage with the corresponding key guide parts 12 of the key frame 10 (see FIG. 4B). Although the positions of the free ends of the white keys 20 in the key-alignment direction are not limited to the normal positions in the course of the attachment operation, because of the presence of the vertical hinge parts 24 (see FIGS. 2 and 3), the key guide parts 12 are guided by the guide parts 32 to suitably engage with the key guided parts 33. Thus, the positions in the key-alignment direction of the free ends of the white keys 20 can be simply and appropriately defined. In this connection, as the exact sequence of operations, in the attachment process, the engagement of the key guide parts 12 and the key guided parts 33 starts slightly prior to the fitting of the elastic members 31 in the fitting concave parts 55 of the mass bodies 50.

When all the elastic members 31 have been engaged with the fitting concave parts 55 of the mass bodies 50, the common base end part 30 of the key unit KU is positioned directly above the securing parts 15, 16 of the key frame 10, i.e. in a position in which the common base end part 30 can be immediately secured. Accordingly, thereafter, pressing down the common base end part 30 from an upward direction causes the contact surfaces 27, 28 of the common base end part 30 to fit in contact against and facing the securing parts 15, 16. By subsequently fastening with the screw 82 (see FIG. 1), the common base end part 30 can be easily secured to the key frame 10.

Although a plurality of the key units KU are used, the method of attachment is the same for the other key units KU. In this connection, an operation to secure the common base end part 30 to the key frame 10 may be performed after the elastic members 31 of all the key units KU have been engaged with the fitting concave parts 55 of the mass bodies 50.

According to the present embodiment, the configuration is adopted, in which, by means of an operation that moves the key unit KU rearward, all of the elastic members 31 are simultaneously engaged between the lower engaging pieces 53 and the upper engaging pieces 54 of the mass bodies 50, and at that time the common base end part 30 is positioned in a position in which the common base end part 30 can be secured to the key frame 10. Thus, in a keyboard apparatus having the mass bodies 50, an operation to attach a plurality of keys can be made easier in comparison to a configuration in which keys are attached individually. Further, since the sloping surface 19 fulfills the function as a mounting guide for the key unit KU, mounting of the key unit KU is simplified further. Also, since the key guided parts 33 of the white keys 20 automatically engage with the key guide parts 12 when the elastic members 31 engage with the fitting concave parts 55, an operation to engage the key guided parts 33 with the key guide parts 12 is simple.

Furthermore, operations to attach the key unit KU to the key frame 10 can be made simpler and smoother by setting a slope of the sloping surface 19, setting a vertical position of the sloping surface 19, and setting the clearance C1 between the rear end of the sloping surface 19 and the front end of the lower engaging piece 53 of the mass body 50 and the like as described above.

Since the sloping surface 19 also functions as a mounting guide for the mass bodies 50, not only is attachment of the mass bodies 50 facilitated, but the structure also does not become complicated.

Next, a second embodiment of the present invention will be described.

Figure 8:
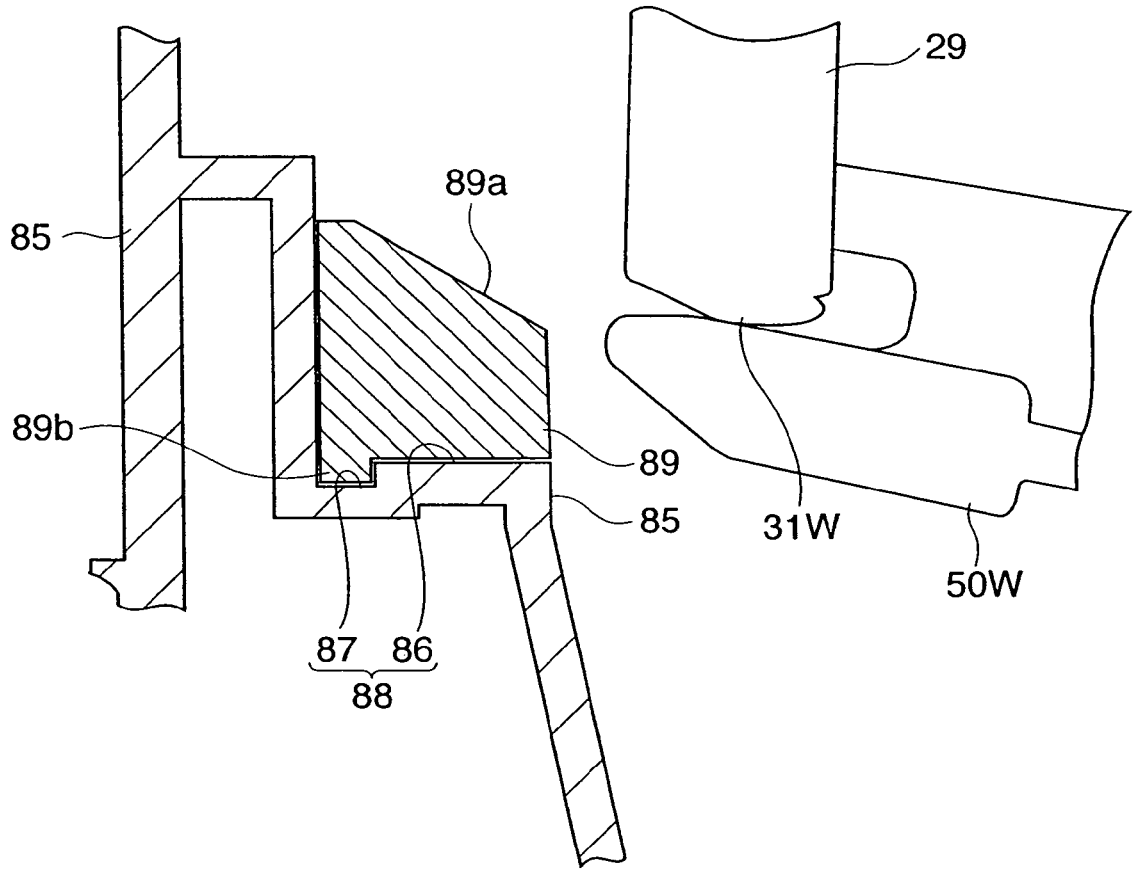
FIG. 8 is a fragmentary sectional view of a front part of a keyboard apparatus according to a second embodiment of the present invention.

In the second embodiment of the present invention, the structure of the key frame differs in comparison to the above described first embodiment, and the other structures are the same as the first embodiment. FIG. 8 is a fragmentary sectional view of a front part of a keyboard apparatus according to the second embodiment of the present invention.

In the first embodiment, the sloping surface 19 (see FIG. 4A) is formed at the front part of the key frame 10. In contrast, in the second embodiment a guiding member having a sloping surface that corresponds to the sloping surface 19 is constructed as a separate member from the key frame, and this guiding member is provided for the key frame in a detachable condition.

As shown in FIG. 8, a guiding member mounting part 88 is formed at a front part of a key frame 85. The guiding member mounting part 88 is composed of a mounting part 86 and a groove 87 that is dropped one level compared to the mounting part 86. The guiding member mounting part 88 is formed to have a uniform cross section across the entire width of the keyboard. A guiding member 89 can be mounted to and detached from the guiding member mounting part 88. The guiding member 89 is formed to have a uniform cross section, and has a length that is slightly longer than the entire width of the entire keyboard.

The undersurface of the guiding member 89 is formed with a step shape that corresponds to the mounting part 86 and the groove 87, and the guiding member 89 is put in a mounted state by merely placing the guiding member 89 on the mounting part 86 and the groove 87. At this time, by fitting a protruding part 89*b* of the guiding member 89 into the groove 87, the guiding member 89 is prevented from dropping down to the rear from the guiding member mounting part 88. A sloping surface 89*a* that corresponds to the sloping surface 19 is formed at the top of the guiding member 89. In the mounted state, the shape of the sloping surface 89*a* is the same as the sloping surface 19. The material of the guiding member 89 is not particularly limited, and it can be consist of resin or felt, or a product by hollow aluminum extrusion or the like.

In this structure, attachment of the mass bodies 50 and the key unit KU is carried out in the following manner. First, prior to attaching the mass bodies 50, the guiding member 89 is mounted onto the guiding member mounting part 88. At this time, to facilitate detachment as described later, the guiding member 89 is exposed a little from at least either one of the right side and left side of the keyboard apparatus 1. Then, utilizing the sloping surface 89*a* of the guiding member 89 as a mounting guide, the mass bodies 50 are attached by the same method as in the first embodiment. Thereafter, utilizing the sloping surface 89*a* as a mounting guide, the key unit KU is attached by the same method as in the first embodiment.

After attachment of all of the key units KU is completed, in that state, the guiding member 89 is pulled out from the side of the keyboard apparatus 1 by holding the exposed portion of the guiding member 89 to thereby detach the guiding member 89. There is no necessity to disassemble the keyboard apparatus 1 in order to detach the guiding member 89, and the guiding member 89 can be detached with ease. In this manner attachment of the mass bodies 50 and the key unit KU is carried out. Upon detaching the guiding member 89, an empty space is created in the region in which the guiding member 89 was present above the guiding member mounting part 88. Various functional components can be provided in this empty space. For example, a lampholder for a performance guide or sensors or the like may be provided.

In this connection, when producing a large number of keyboard apparatuses consecutively by using flow production or the like, utilizing the guiding member 89 to assemble a plurality of keyboard apparatuses produces favorable workability. More specifically, the guiding member 89 that has been detached from the keyboard apparatus that has been most recently assembled can be used in the keyboard apparatus to be assembled next.

A similar effect as the first embodiment can be obtained according to the present embodiment. Furthermore, since the empty space that exists after removing the guiding member 89 can be effectively utilized for providing various functional components and the like, the embodiment not only contributes to space saving within the keyboard apparatus 1, but, in addition, the degree of design freedom is increased and applying to multiple models is also facilitated. Further, this empty space is also useful in the respect that various functional components can be retrofitted into the empty space even after delivery of the keyboard apparatus 1.

A configuration may be adopted in which the guiding member 89 can be detached while the mass bodies 50 and the key unit KU are in an attached state, and the length of the guiding member 89 need not be the same as the entire width of the keyboard. For example, the length of the guiding member 89 may be that same as the width of one key unit KU, and the guiding member 89 may be detached each time one key unit KU is attached. Further, when the length of the guiding member 89 is configured to be the same as the width of one key unit KU, a plurality of guiding members 89 need not necessarily be provided, and only one guiding member 89 may be provided. In that case, for example, a method may be employed in which, after attaching mass bodies 50 for one octave utilizing the guiding member 89, the guiding member 89 is shifted laterally by a distance equivalent to an amount for one octave, and the mass bodies 50 for the next one octave are then attached. Likewise for the key units KU, a method may be employed whereby after attaching one key unit KU utilizing the guiding member 89, the guiding member 89 is shifted laterally by a distance equivalent to the amount for one octave to attach the next key unit KU.

In this connection, when there is no necessary to secure an empty space, the guiding member 89 need not be configured to be detachable from the keyboard apparatus 1, and the keyboard apparatus 1 may be considered a finished product in a state in which the guiding member 89 is mounted therein.

Although in the first and second embodiments the key unit KU is configured as a three-level structure, from the viewpoint of facilitating operations to attach a plurality of keys, this invention is not limited thereto, and any configuration may be adopted as long as a plurality of keys are integrally connected at a common base end part.

Although in the first and second embodiments the configuration is adopted in which the positions of the upper engaging piece 54 and lower engaging piece 53 of the mass body 50 are the same in the front-to-rear direction and vertical direction between the engaging pieces corresponding to the white keys 20 and the engaging pieces corresponding to the black keys 40, from the viewpoint of facilitating operations to attach a plurality of keys, the present invention is not limited thereto, and the positions of these pieces in the front-to-rear direction and vertical direction may differ somewhat. In that case, the key unit KU may be configured so that the positions of the respective elastic members 31 in the key unit KU respectively match the positions of the corresponding upper engaging pieces 54 and lower engaging pieces 53, and so that at the time of attachment all the elastic members 31 simultaneously contact against and engage with the corresponding upper engaging pieces 54 and lower engaging pieces 53.

Figure 9:
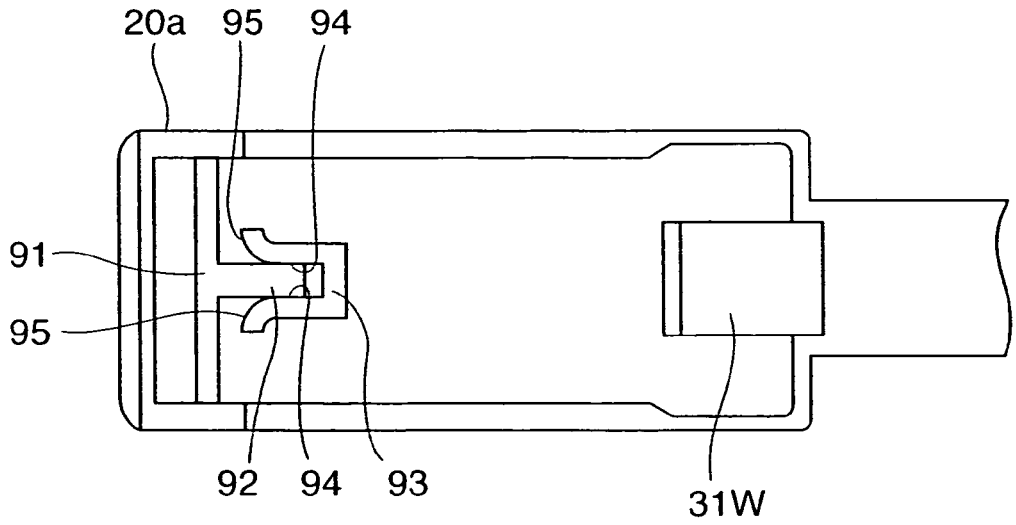
FIG. 9 is a view of a back side of a front half of a white key that shows a modification example of a key guide part and a key guided part.

Although in the above described first and second embodiments the guide parts 32 (see FIG. 4B) that guide the key guide part 12 and the key guided parts 33 into an engaged state are provided in the key guided parts 33, i.e. the white keys 20, conversely, the guide parts 32 may be provided in the key frame 10. FIG. 9 is a view of a back side of the front half of the white key that shows a modification example of the key guide part and the key guided part.

For example, as shown in FIG. 9, in a front end part 20*a* of the white key 20, a T part 91 that is shaped in the form of the letter "T" as viewed from the bottom is integrally formed along the vertical direction. In the T part 91, a key guided part 92 is provided to extend rearward from a rib that is parallel to the horizontal direction. The key guided part 92 corresponds to the above described key guided part 33. At the most frontward part of the key frame 10, a concave part 93 that opens frontward as viewed from the bottom is formed at a position corresponding to the key guided part 92 of each white key 20 along the vertical direction.

The concave part 93 has a key guide part 94 that has a width that is slightly larger than the width of the key guided part 92, and also has a guide part 95 that joins to the front part of the key guide part 94 and is formed in a manner in which the key guide part 94 and the guide part 95 are integrated with each other. The key guide part 94 corresponds to the above described key guide part 12. The guide part 95 fulfills a function that corresponds to the above guide part 32 (see FIG. 4(B)).

In this configuration, when attaching the key unit KU to the key frame 10, the guide part 95, similarly to the above guide part 32, fulfills a guiding function so that the key guide part 94 and the key guided part 92 engage appropriately. In this connection, the shapes of the key guide part, the key guided part and the guide part are not limited to the shapes exemplified in the foregoing.

What is claimed is:

1. A keyboard apparatus comprising:

a key unit in which a plurality of keys having driving parts are integrally connected by a common base end part in a condition in which said keys are pivotally movable;

a support member having a key base end part securing part; and a plurality of mass bodies having driven parts disposed in correspondence to said driving parts of said keys, respectively, and which are disposed in a pivotally movable condition with respect to said support member;

wherein an assembled state is achieved when said common base end part of said key unit is secured to said key base end part securing part of said support member and said driving parts of said keys of said key unit are engaged with said corresponding driven parts of said mass bodies, respectively;

the keyboard apparatus being configured such that, in the assembled state, in response to a pivotal movement of each of said keys, said corresponding driven parts of said mass bodies are driven by said driving parts of said keys, respectively, so that said corresponding mass bodies pivotally move; and by moving said key unit in a longitudinal direction of said keys in a state in which said plurality of mass bodies are disposed in said support member, said driving parts of all of said keys of said key unit simultaneously engage with said corresponding driven parts of said mass bodies, respectively, and when said driving parts are simultaneously engaged with said driven parts, said common base end part of said key unit is positioned at a position in which said common base end part can be secured to said key base end part securing part of said support member.

2. The keyboard apparatus according to claim 1, wherein any of said plurality of keys of said key unit is white key, a key guided part is provided at a front end part of each of said white keys, key guide parts is provided in said support member in correspondence to said key guided parts of said white keys, said key guide parts engage with said key guided parts of said white keys in the assembled state to guide pivotal movements of said corresponding white keys, the longitudinal direction of said keys is a rearward direction of the keyboard apparatus, and substantially simultaneously to said driving parts of said keys of said key unit engaging simultaneously with said corresponding driven parts of said mass bodies, said key guided parts of said white keys engage with said corresponding key guide parts.

3. The keyboard apparatus according to claim 1, comprising a key mounting guide part that guides said driving parts of said keys of said key unit to said corresponding driven parts of said mass body in a process for attaching said key unit.

4. The keyboard apparatus according to claim 1, comprising a guiding member that is configured as a separate member to said support member, wherein said support member is provided with a mounting part for mounting said guiding member, in said guiding member, a key mounting guide part that guides said driving parts of said keys of said key unit to said corresponding driven parts of said mass bodies when said key unit is attached in a state in which said guiding member is mounted on said mounting part of said support member, and said guiding member can be detached from said mounting part in a state in which said key unit is still attached thereto after attachment of said key unit.

5. The keyboard apparatus according to claim 3, wherein said key mounting guide part defines a position in a vertical direction of said driving part of each key in a process for attaching said key unit by contacting against said driving part, and a sectional form in a side view direction of a plurality of contact locations that contact against said driving part of each key in said key mounting guide part is the same for the plurality of contact locations.

6. The keyboard apparatus according to claim 3, wherein said key mounting guide part defines a position in a vertical direction of said driving part of each key in a process for attaching said key unit by contacting against said driving part, a position in a vertical direction of said key mounting guide part in attaching said key unit is adjacent to an upper end position of said driven parts of said mass bodies disposed in said support member.

7. The keyboard apparatus according to claim 3, wherein said key mounting guide part defines a position in a vertical direction of said driving part of each key in a process for attaching said key unit by contacting against said driving part, and a clearance between said key mounting guide part and each of said driven parts of said mass bodies disposed in said support member is less than a width in a front-to-rear direction of said corresponding driving part of said key of said key unit.

8. The keyboard apparatus according to claim 3, wherein said key mounting guide part defines a position in a vertical direction of said driving part of each key in a process for attaching said key unit by contacting against said driving part, and said key mounting guide part slopes downward towards a side of each of said driven part of said mass bodies.

9. The keyboard apparatus according to claim 3, comprising a mass body mounting guide part for disposing said plurality of mass bodies in a pivotally movable condition in said support member.

10. The keyboard apparatus according to claim 9, wherein said mass body mounting guide part also serves as said key mounting guide part.

11. A method of producing a keyboard apparatus comprising a key unit in which a plurality of keys having driving parts are integrally connected by a common base end part in a condition in which the keys are pivotally movable; a support member having a key base end part securing part; and a plurality of mass bodies having driven parts disposed in correspondence to the driving parts of the keys, respectively, and which are disposed in a pivotally movable condition with respect to the support member; wherein an assembled state is achieved when the common base end part of the key unit is secured to the key base end part securing part of the support member and the driving parts of the keys of the key unit are engaged with the corresponding driven parts of the mass bodies, respectively; and the keyboard apparatus being configured such that, in the assembled state, in response to a pivotal movement of each of the keys, the corresponding driven parts of the mass bodies are driven by the driving parts of the keys, respectively, so that the corresponding mass bodies pivotally move; the method being a method for attaching the plurality of mass bodies and the key unit to the support member, comprising the steps of:

disposing the plurality of mass bodies in the support member in a condition in which each mass body is pivotally movable;

engaging the driving parts of all of the keys of the key unit with the corresponding driven parts of mass bodies, respectively, by moving the key unit in a longitudinal direction of the keys, simultaneously, and positioning the common base end part of the key unit at a position in which the common base end part can be secured to the key base end part securing part of the support member; and securing the common base end part of the key unit to the key base end part securing part of the support member.

12. A method of producing a keyboard apparatus comprising a key unit in which a plurality of white keys having driving parts and provided with key guided parts at respective front end parts and a plurality of black keys having driving parts are integrally connected in a pivotally movable condition, respectively, by a common base end part; a support member provided with a key base end part securing part and key guide parts that correspond to the key guided parts of the white keys of the key unit and engages with the corresponding key guided parts to guide pivotal movements of the corresponding white keys, respectively; and a plurality of mass bodies that have driven parts disposed in correspondence to the driving parts of the keys and that are disposed in a pivotally movable condition with respect to the support member; wherein an assembled state is achieved when the common base end part of the key unit is secured to the key base end part securing part of the support member, and the driving parts of the keys of the key unit are engaged with the corresponding driven parts of the mass bodies, respectively; the keyboard apparatus being configured such that, in the assembled state, in response to a pivotal movement of each of the keys, the corresponding driven parts of the mass bodies are driven by the driving parts of the keys, respectively, so that the corresponding mass bodies pivotally move; the method being a method for attaching the plurality of mass bodies and the key unit to the support member, comprising the steps of:

disposing the plurality of mass bodies in the support member in a condition in which each mass body is pivotally movable;

engaging the driving parts of all of the keys of the key unit with the corresponding driven parts of mass bodies, simultaneously, by moving the key unit rearward, and at substantially the same time, engaging the key guided parts of the white keys with the corresponding key guide parts, respectively, and positioning the common base end part of the key unit at a position in which the common base end part can be secured to the key base end part securing part of the support member; and securing the common base end part of the key unit to the key base end part securing part of the support member.

13. A keyboard apparatus comprising:

a key unit in which a plurality of keys including black keys and white keys having driving parts are integrally connected by a common base end part in a condition in which each key is pivotally movable;

key guided parts each of which is provided at a front end part of each of said white keys among said plurality of keys of said key unit;

a support member having a key base end part securing part;

key guide parts that are provided in said support member and correspond to said key guided parts of said white keys, respectively, and that engage with said key guided parts in an assembled state to guide pivotal movements of said corresponding white keys; and a plurality of mass bodies that have driven parts that are disposed in correspondence to the driving parts of said keys, respectively, and that are provided in a pivotally movable condition with respect to said support member;

wherein an assembled state is achieved when said common base end part of said key unit is secured to said key base end part securing part of said support member, and said driving parts of said keys of said key unit are engaged with said corresponding driven parts of said mass bodies, respectively;

the keyboard apparatus being configured such that, in the assembled state, in response to a pivotal movement of each of said keys, said corresponding driven parts of said mass bodies are driven by said driving parts of said keys, respectively, so that said corresponding mass bodies pivotally move; and by moving said key unit in a longitudinal direction of said keys in a state in which said plurality of mass bodies are disposed in said support member, said key guided parts of all said white keys of said key unit simultaneously engage with said corresponding key guide parts, respectively, and when said key guided parts of all said white keys are simultaneously engaged with said corresponding key guide parts, said common base end part of said key unit is positioned at a position in which said common base end part can be secured to said key base end part securing part of said support member.

14. The keyboard apparatus according to claim 13, wherein any one of said key guide part and said key guided part is provided with an engaging guide part that guides said key guide part and said key guided part into an engaged state.

15. The keyboard apparatus according to claim 13, wherein the longitudinal direction of said keys is a rearward direction of said keys.

16. A keyboard apparatus comprising:

a key unit in which a plurality of keys including black keys and white keys having driving parts are integrally connected by a common base end part in a condition in which each key is pivotally movable;

key guided parts each of which is provided at a front end part of each of said white keys among said plurality of keys of said key unit;

a support member having a key base end part securing part;

key guide parts that are provided in said support member and correspond to said key guided parts of said white keys, respectively, and that engage with said key guided parts in an assembled state to guide pivotal movements of said corresponding white keys; and a plurality of mass bodies that have driven parts that are disposed in correspondence to the driving parts of said keys, respectively, and that are provided in a pivotally movable condition with respect to said support member;

wherein an assembled state is achieved when said common base end part of said key unit is secured to said key base end part securing part of said support member, and said driving parts of said keys of said key unit are engaged with said corresponding driven parts of said mass bodies, respectively;

the keyboard apparatus being configured such that, in the assembled state, in response to a pivotal movement of each of said keys, said corresponding driven parts of said mass bodies are driven by said driving parts of said keys, respectively, so that said corresponding mass bodies pivotally move; and by moving said key unit in a longitudinal direction of said keys in a state in which said plurality of mass bodies are disposed in said support member, said driving parts of all said keys of said key unit simultaneously engage with said corresponding driven parts of said mass bodies, respectively, and in parallel with which, said key guided parts of all said white keys of said key unit simultaneously engage with said corresponding key guide parts, and when said driving parts are simultaneously engaged with said driven parts, said common base end part of said key unit is positioned at a position in which said common base end part can be secured to said key base end part securing part of said support member.

17. The keyboard apparatus according to claim 16, wherein any one of said key guide part and said key guided part is provided with an engaging guide part that guides said key guide part and said key guided part into an engaged state.

18. The keyboard apparatus according to claim 16, wherein the longitudinal direction of said keys is rearward.

* * * * *